US006360845B1

(12) United States Patent
Allison

(10) Patent No.: US 6,360,845 B1
(45) Date of Patent: Mar. 26, 2002

(54) SINGLE STILE LADDER HAVING DUAL ADJUSTABLE LEG SUPPORTS

(76) Inventor: Kenneth David Allison, 870 1st St., Charleton, IL (US) 61920

( * ) Notice: Subject to any disclaimer, the term of this patent is extended or adjusted under 35 U.S.C. 154(b) by 0 days.

(21) Appl. No.: 09/590,235

(22) Filed: Jun. 8, 2000

(51) Int. Cl.[7] ..... E04G 5/02; E06C 7/06
(52) U.S. Cl. ..... 182/107; 182/214
(58) Field of Search ..... 182/107, 214, 182/100, 189, 178.1

(56) References Cited

U.S. PATENT DOCUMENTS 2,744,674 A * 5/1956 Smith ..... 182/189
3,019,851 A * 2/1962 Doss ..... 182/189 X
3,026,962 A * 3/1962 Kramer ..... 182/189 X
3,995,714 A * 12/1976 Brookes et al. ..... 182/100
4,184,569 A * 1/1980 Grenier ..... 182/214 X
4,502,566 A * 3/1985 Wing ..... 182/214
4,892,170 A * 1/1990 O'Donnell ..... 182/100
5,121,814 A * 6/1992 Southern ..... 182/214

* cited by examiner

*Primary Examiner*—Daniel P. Stodola
*Assistant Examiner*—Hugh B. Thompson
(74) *Attorney, Agent, or Firm*—John D. Gugliotta

(57) ABSTRACT

A ladder is provided that utilizes one central rail located in the center of the step in lieu of two on the outside as found on conventional ladders. The ladder has a lower section is approximately 5 feet in length and uses square tube stock for the central rail. A leg support piece is connected and adjustable by the use of locking pins and pre-drilled pipe. The upper section is also approximately 5 feet in length and has a contact arm to hold it away from the surface it is leaning against. The upper and the lower center rail are connected to one another with the use of a locking pin.

2 Claims, 7 Drawing Sheets

SINGLE STILE LADDER HAVING DUAL ADJUSTABLE LEG SUPPORTS

BACKGROUND OF THE INVENTION

1. Field of the Invention

The present invention relates generally to ladders with a single stile and, more particularly, to a single stile ladder having dual adjustable leg supports.

2. Description of the Related Art

In the related art, typical "A" frame ladders are well known and widely used in order to allow its user to gain access to areas that otherwise would be inaccessible. However, as handy as these ladders are, they are not without their disadvantages. First, the small footprint they present to the grade, often results in them being prone to tipping over. The same low profile disadvantage is also exaggerated at the top when a user leans over to reach a vertical surface. Also due to nature of most conventional ladders, there is no opportunity to stand-off the ladder from the vertical surface, thus not allowing ideal placement of the ladder. Finally, the outside rails of the ladder often get in the way when climbing and add excessive weight to the ladder.

Numerous attempts have been made to correct for the foregoing problems. The following patents all disclose a ladder with a central rod with extending rungs:

U.S. Pat. No. 5,860,490 issued in the name of Petti et al.

U.S. Pat. No. 5,816,362 issued in the name of Jenkins, Jr.

U.S. Pat. No. 5,806,626 issued in the name of Jenkins, Jr.

U.S. Pat. No. 5,752,580 issued in the name of Jenkins, Jr.

U.S. Pat. No. 5,439,072 issued in the name of Jenkins, Jr.

U.S. Pat. No. 5,040,635 issued in the name of Strickland

U.S. Pat. No. 4,607,725 issued in the name of Brinkmann et al.

U.S. Pat. No. 4,263,983 issued in the name of Norton

U.S. Pat. No. 4,069,892 issued in the name of Lynne et al.

U.S. Pat. No. 973,103 issued in the name of Boyd

U.S. Pat. No. 2,957,538 issued in the name of Pottmeyer describes new ladder bolts for center stile ladders.

U.S. Pat. No. D 394,715 issued in the name of Pearson discloses the ornamental design of a central bin ladder.

Consequently, a need has been felt for providing a means by which extension ladders can access high locations without the disadvantages associated with conventional extension ladders.

SUMMARY OF THE INVENTION

Therefore, it is an object of the invention to indicate a device of the type disclosed above which avoids the disadvantages inherent in the state of the art.

It is therefore an object of the present invention to provide an improved a single stile ladder having dual adjustable leg supports, touchdown arms for added stability, and a handle located at the top.

Briefly described according to the preferred embodiment of the present invention, a style of ladder is provided that utilizes one central rail located in the center of the step in lieu of two on the outside as found on conventional ladders. The ladder is sectionalized allowing it to function for areas that require low and high access. The lower section uses square tube stock for the central rail. A leg support piece, by which the invention makes contact with grade, is connected and adjustable by the use of locking pins and pre-drilled pipe. The upper section has a touch down arm to hold it away from the surface it is leaning against. The touch down arm is protected with rubber pads to prevent any damage to the vertical surface as well. The upper and the lower center rail are connected to one another with the use of a locking pin also.

The use of the present invention allows for a climbing aid to be positioned and used in a manner that is quick, easy and effective when compared to a conventional ladder.

Advantages are provided by the use of the one center rail instead of two, including making the ladder easier to climb, preventing the user's knees from banging on the ladder while climbing, and make for easier foot placement and quick setup.

Advantages are provided by the use of leg support assembly, which provides a mechanism by which the ladder sits on the ground, allows the ladder to be used on uneven ground, provides for increased safety, allowing for level configuration and improve outdoor use in being less prone to tipping.

Use of touch down arms provides a mechanism by which the ladder rests against the vertical surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

Figure 1:
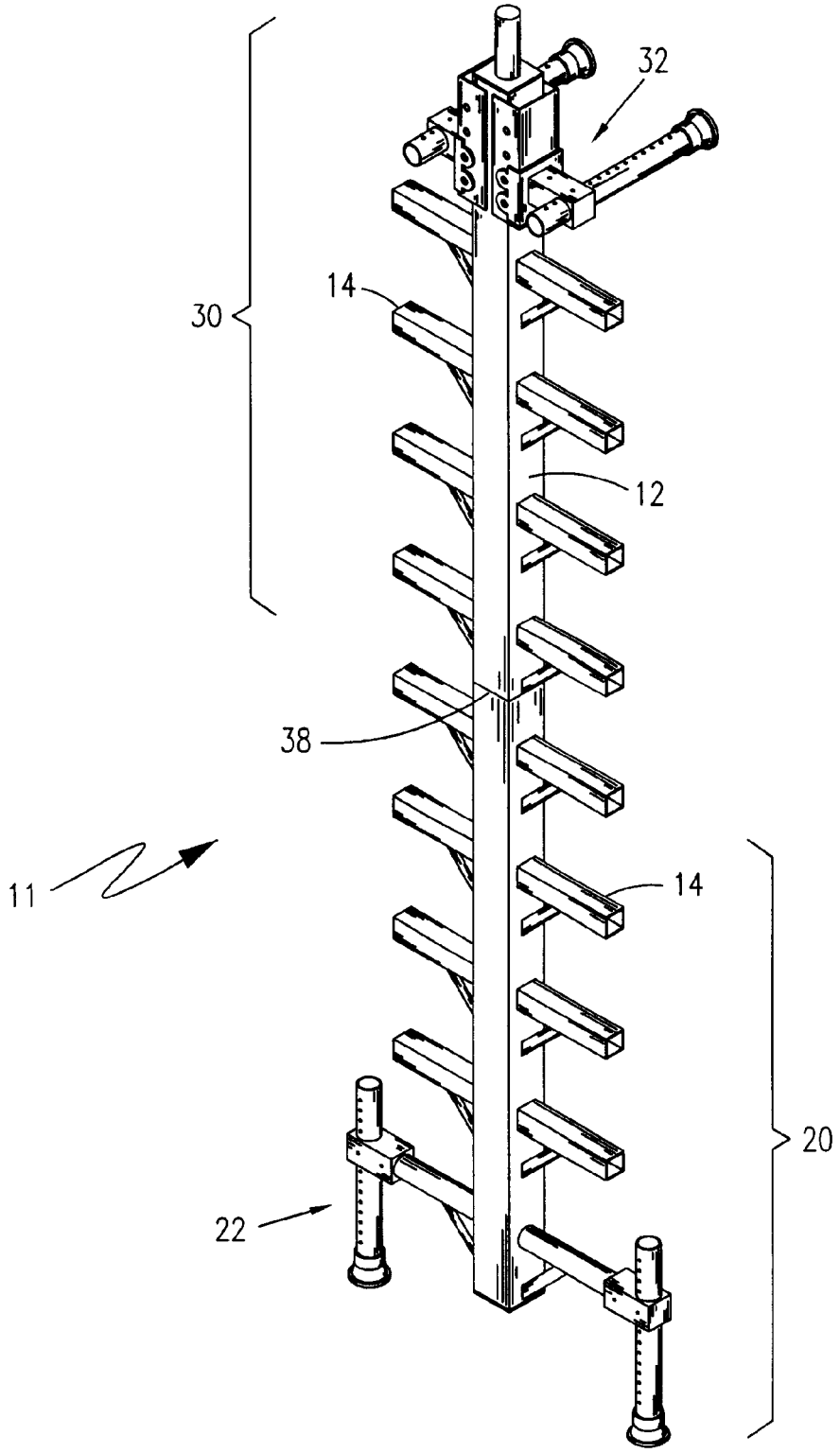
FIG. 1 is a perspective view of a single stile ladder having dual adjustable leg supports according to the preferred embodiment of the present invention.
Figure 2:
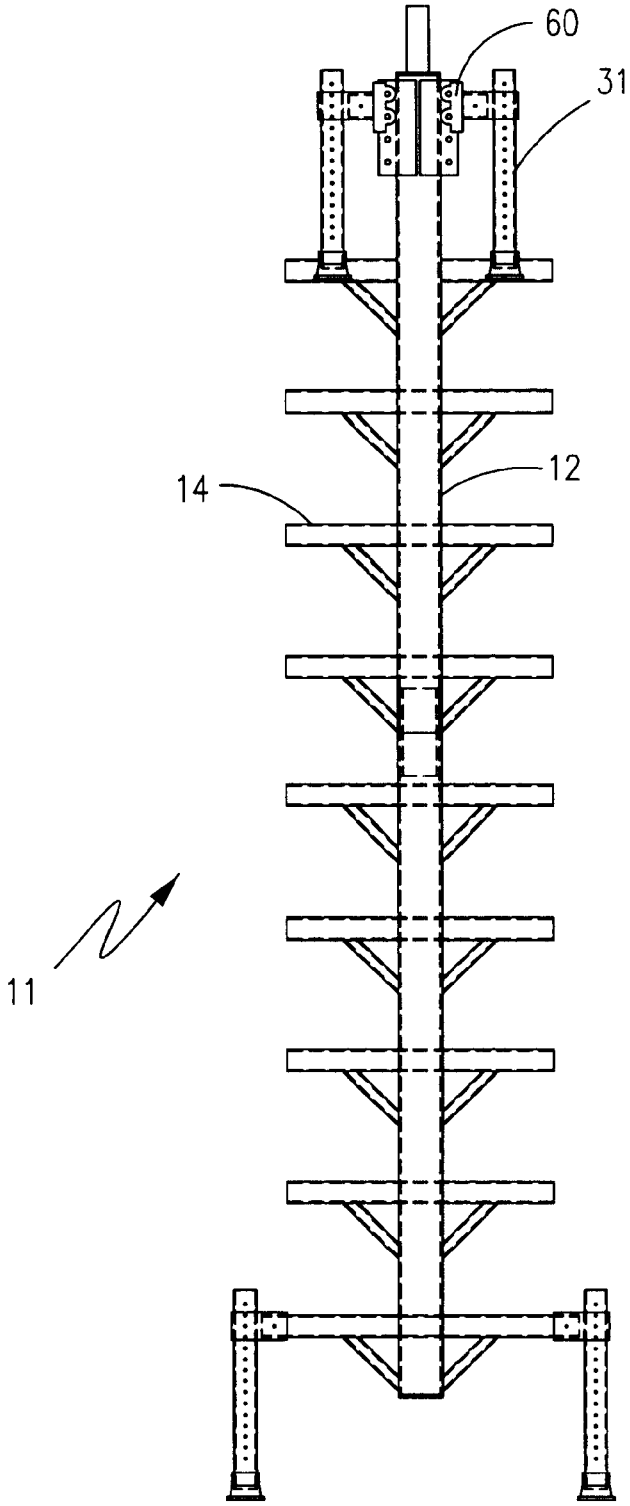
FIG. 2 is a front elevational view thereof.
Figure 3:
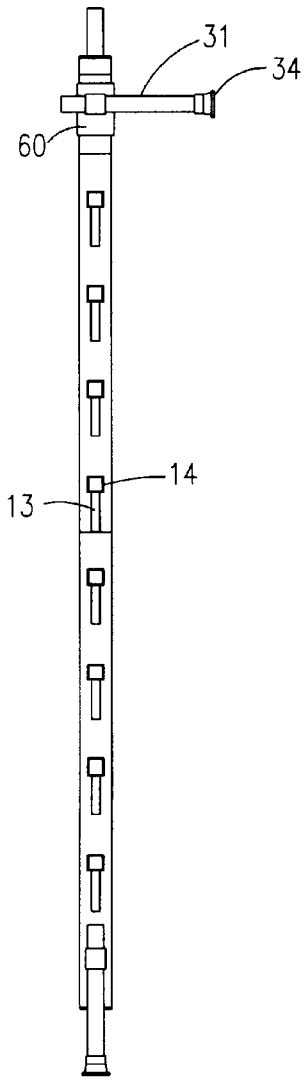
FIG. 3 is a side elevational view thereof, the opposite side being a mirror image.
Figure 4:
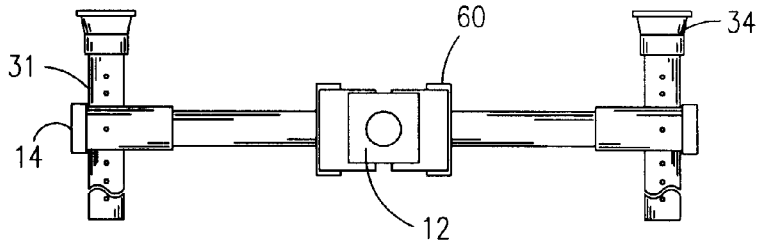
FIG. 4 is a top plan view thereof.

Referring generally now to FIG. 1–4, a single stile ladder 11 is shown, according to the present invention, that utilizes one central rail 12 located along a vertical linear centerline. This central rail 12 is envisioned as being formed as a heavy gauge, extruded metal square tube stock forming a pair of parallel sides 13 along its vertical length. A plurality of steps 14 are linearly align along each side 13.

The central rail 12 is sectionalized allowing it to function for areas that require low and high access. A lower section 20 is approximately 5 feet in length and uses square tube stock for the central rail. A leg support assembly 22, by which the ladder 11 makes contact with grade, is connected and adjustable by the use of locking pins 24 as described in further detail below. The upper section 30 is also approximately 5 feet in length and has a contact arm 31 to hold it away from the surface it is leaning against. The contact arm 31 is protected with rubber pads 34 to prevent any damage to the vertical surface as well. The upper and the lower center rail 12, 30 are connected to one another with the use of a central connection means 38, envisioned as using locking pins also.

Figure 5:
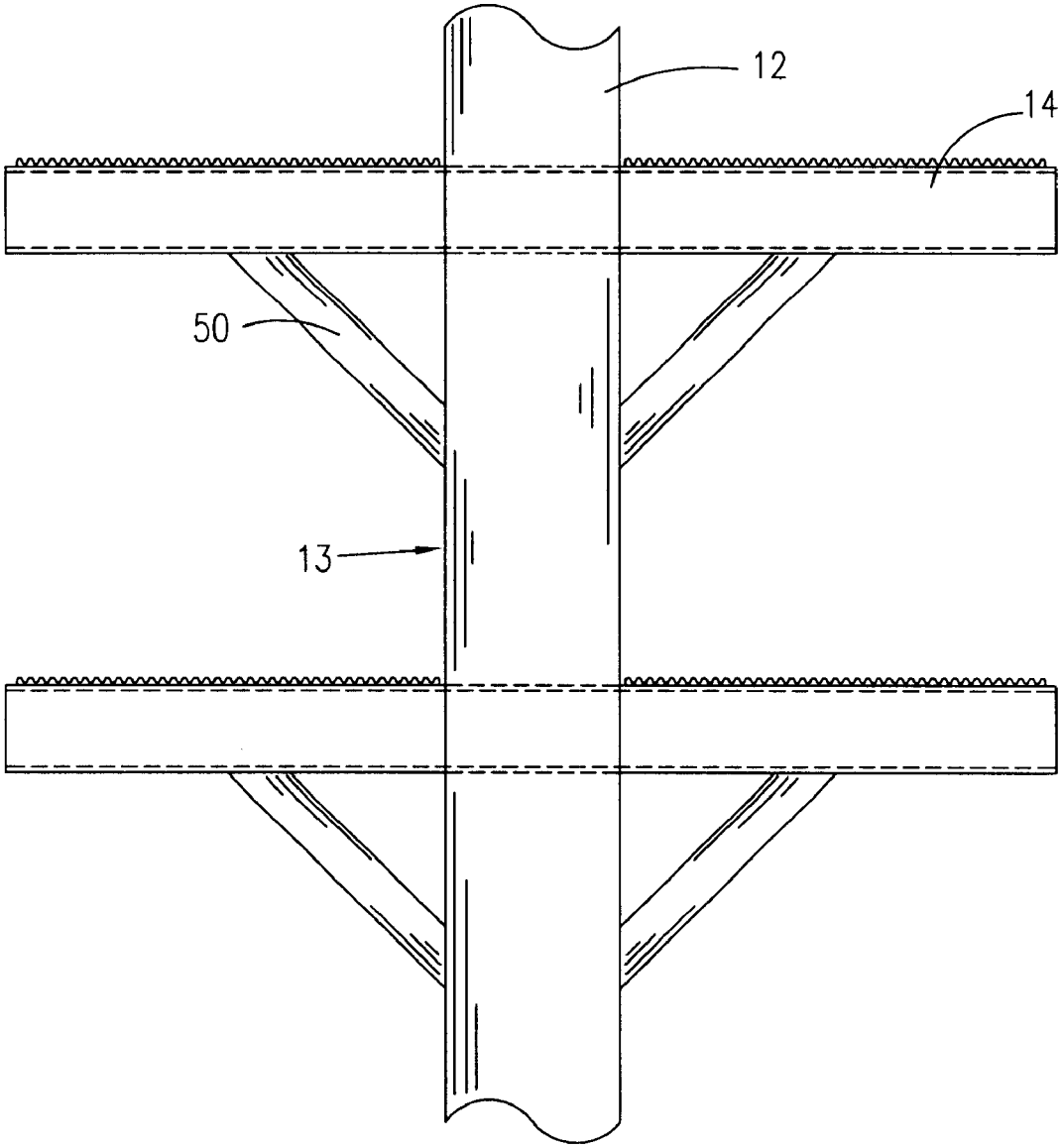
FIG. 5 is a partial detailed front elevational view of a step 14 shown attached to a central rail 12 for use with the present invention.
Figure 6:
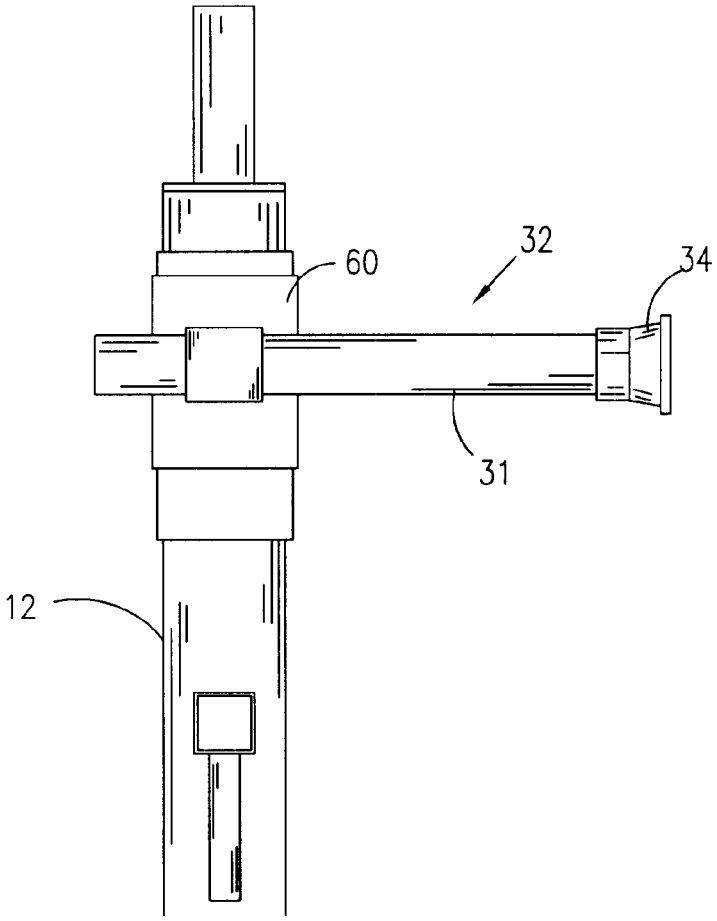
FIG. 6 is a partial detailed side elevational view of a contact arm assembly 32 shown attached to a central rail 12 for use with the present invention.

Referring now to FIG. 5 and FIG. 6, detailed views of the step 14 is shown attached to a central rail 12. In its preferred embodiment, each step 14 is envisioned as being formed as a two inch wide by twelve inch long step mounted through the central rail 12 such as to extend outward from each side 14. In this manner, the central rail 12 itself forms the female portion of the connection joint, and the step 14 itself forms the male portion of the connection joint. A step support 50 both affixes each step 14 to the rail 12 to prevent horizontally lateral displacement, as well as providing additional structural integrity against the step 14 for improved load bearing. Along the upper surface 54 of each step 12 is a gripping means 56, herein envisioned as a rough surface treatment or attached gripping surface of rubber or the like.

Referring now to FIG. 6, detailed views of a contact arm assembly 32 is shown. A track runner 60 is pivotally affixed to the central rail 12 at its upper end. The track runner 60 is linearly elongated such that when the contact arm 31 is pivoted upward, it will allow a horizontal extension between the central rail 12 and a vertical wall or surface against which the ladder 11 is rested.

Figure 7:
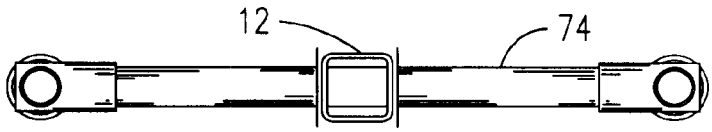
FIG. 7 is a partial detailed top plan view of a leg support assembly 22 for use with the present invention.
Figure 8:
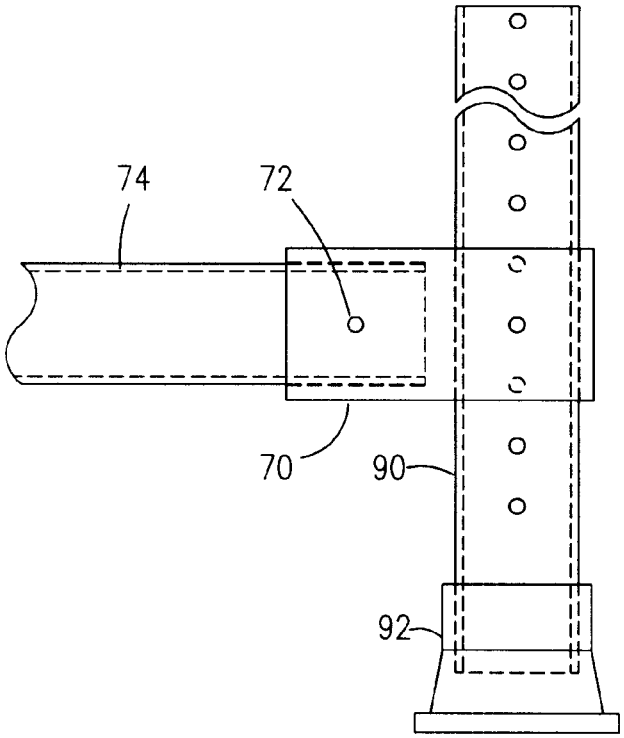
FIG. 8 is a partial detailed side elevational view of a leg support assembly 22 for use with the present invention.
Figure 9:
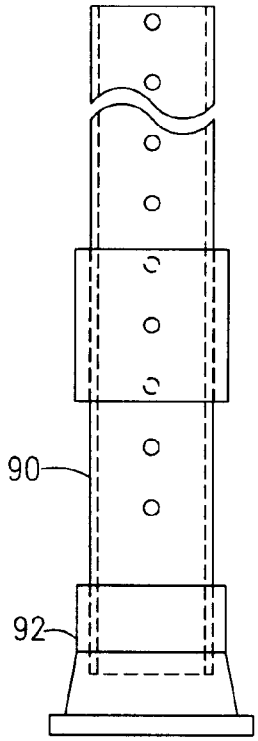
FIG. 9 is a partial detailed front elevational view of a leg support assembly 22, for use with the present invention.

Referring now to FIGS. 7–9, a detailed front elevational view of the leg support assembly 22 is shown. A leg support arm 74 affixes rigidly to the central rail 12, and a rail clamp 70 further provides a locking release mechanism 72 to releasably affix to the leg support arm 74 for providing a horizontal offset to each lateral side of the central rail 12 for attachment of a pair of support legs 90. Each support leg 90 has a vertical adjustment means for allowing each leg 90 to be aligned at a particular elevation, independent of each other. At the base of each leg 90 is a cushioned foot 92 to allow for improved gripping of the leg 90 to a horizontal support surface.

Figure 10:
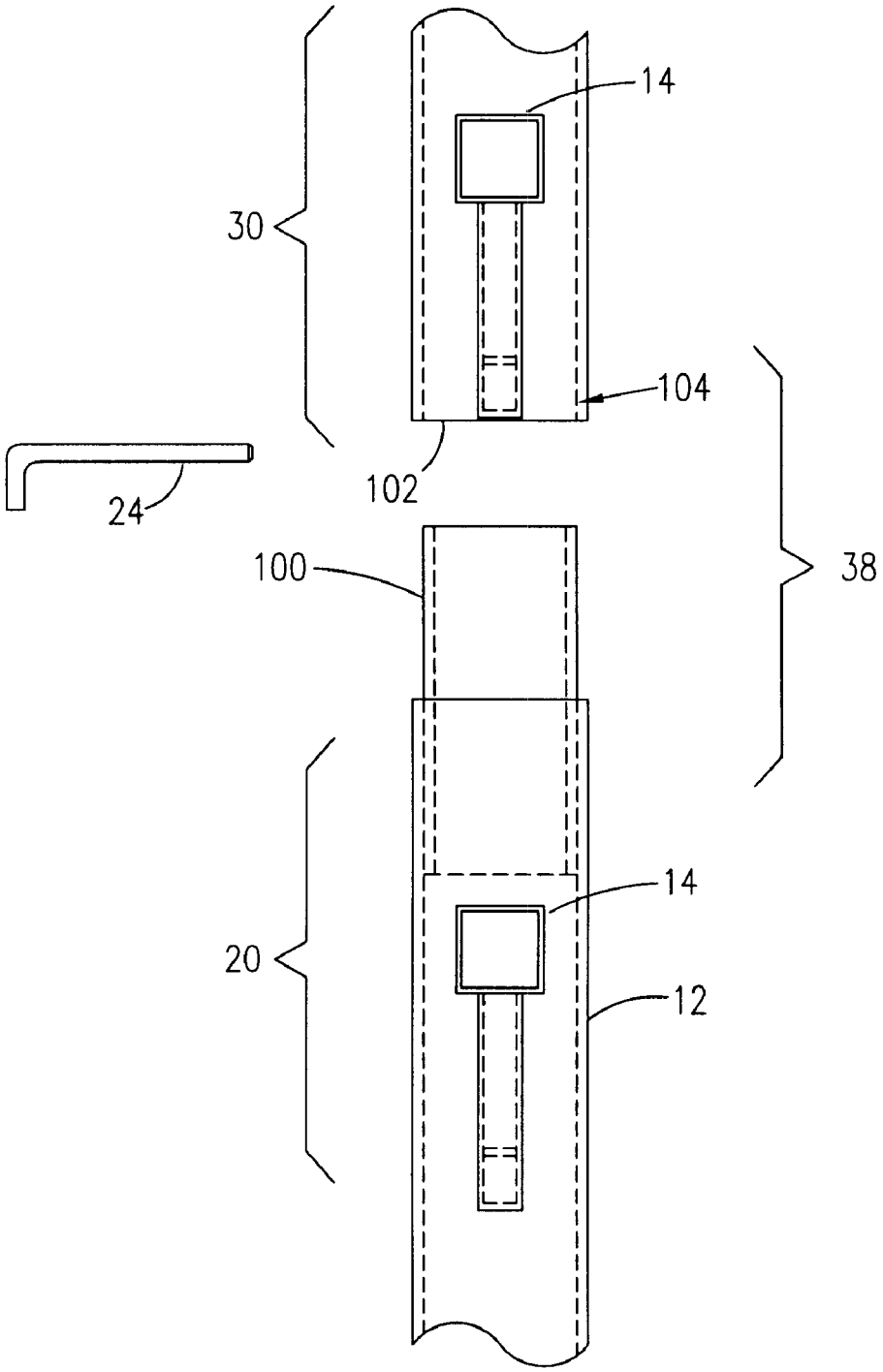
FIG. 10 is a side detailed elevational view of a central connection means 38 for connecting a lower section 20 to an upper section 30 of the present invention.

Referring now to FIG. 10, a side detailed elevational view of the central connection means 38 is shown in which the lower section 20 is attached to the upper section 30 of the present invention. Shown as envisioned, a male coupler 100 protruding from the upper end of the lower section 20 functions as a male connection end to a female receiving shaft 102 formed within the lower end of the upper section 30. A locking pin 24, placed through aligned receiving orifices 104, form a connection joint locking the upper section 30 to the lower section 20.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A ladder comprising:

one central rail located along a vertical linear centerline, said central rail formed as a heavy gauge, extruded metal square tube stock forming a pair of parallel sides along its vertical length, said central rail being sectionalized allowing it to function for areas that require low and high access; and said central rail including a lower section having a leg support assembly, an upper section linearly ,affixed above said lower section, and a contact arm assembly affixed to and extending from said upper section to hold said upper section away from a support surface; and a horizontal leg support arm rigidly affixed to the lower section of said central rail; and a rail clamp which receives ends of the leg support arm, provides a locking release mechanism, which releasably affixes the leg support arm thereto, and slidingly receives a pair of vertical support legs, so as to provide a horizontal offset to each lateral side of the central rail;

and a plurality of steps linearly aligned along each side of said central rail.

2. The ladder of claim 1, wherein said contact arm assembly comprises:

a track runner affixed to said central rail at its upper end, said track runner being linearly elongated such that when a contact arm of said contact arm assembly is pivoted upward, horizontal extension is created between the central rail and said support surface.

* * * * *